United States Patent [19]

Salvagnini

[11] Patent Number: 4,856,315

[45] Date of Patent: Aug. 15, 1989

[54] BENDING MACHINE FOR THE PRODUCTION OF RECTANGULAR SHEET METAL PANELS STARTING FROM FLAT METAL SHEETS

[75] Inventor: Guido Salvagnini, Sarego, Italy

[73] Assignee: Salvagnini Transferica S.p.A., Sarego, Italy

[21] Appl. No.: 138,054

[22] Filed: Dec. 28, 1987

[30] Foreign Application Priority Data

Jan. 9, 1987 [IT] Italy ..... 19046 A/87

[51] Int. Cl.[4] ..... B21D 5/04

[52] U.S. Cl. ..... 72/306; 72/322; 72/446

[58] Field of Search ..... 72/319–323, 72/413, 481, 482, 306, 446

[56] References Cited

U.S. PATENT DOCUMENTS

| | | | |
|---|---|---|---|
| 4,089,198 | 5/1978 | Amano et al. | 72/320 |
| 4,112,731 | 9/1978 | Anderson et al. | 72/320 |
| 4,242,898 | 1/1981 | Salvagnini | 72/307 |
| 4,385,513 | 5/1983 | Salvagnini | 72/320 |
| 4,455,857 | 6/1984 | Salvagnini | 72/320 |
| 4,532,792 | 8/1985 | Hongo | 72/319 |
| 4,658,625 | 4/1987 | Koyama et al. | 762/323 |
| 4,722,214 | 2/1988 | Hayashi et al. | 72/319 |

*Primary Examiner*—Daniel C. Crane

*Attorney, Agent, or Firm*—Cushman, Darby & Cushman

[57] ABSTRACT

The bending machine for the production of rectangular sheet metal panels includes a vertically traversing blank holder which is formed of a plurality of blank-holding elements, two end elements and two spacers, a fixed counterblade, two opposing blades fixed to a vertically traversing C support and structure for positioning the metal sheet to be bent on the counterblade. There are provided on the machine programming elements traversing along the blankholder to vary the side extension of said blankholder according to the dimensions of the metal sheet to be bent. There is also provided the possibility of expanding and contracting the blankholder sidewise at the beginning and at the end respectively of the bending operation of a long side of the metal sheet.

20 Claims, 10 Drawing Sheets

BENDING MACHINE FOR THE PRODUCTION OF RECTANGULAR SHEET METAL PANELS STARTING FROM FLAT METAL SHEETS

BACKGROUND OF THE INVENTION

The present invention relates to a bending machine for the production of rectangular sheet metal panels from flat metal sheets.

A bending machine for the production of rectangular sheet metal panels with beaded edges used in the manufacture of casings for electrical household appliances, metal furniture, shelving, etc., which displays a pair of opposing blades each fixed to an arm of a support in the form of the letter C which traverses vertically so that said blades intercept alternately the side to be bent upward or downward of a metal sheet which is retained between a fixed counterblade and a blank holder is known. This known blank holder raises and lowers onto the metal sheet to retain each time the metal sheet along the edge to be folded.

In the production of boxed panels having the edges folded toward the inside of the panel, it is necessary that the blank holder adjust its lateral extension on the basis of the length of the long side of the panel, there being also provided the capability of expanding or contracting the blank holder laterally to allow its ends to be introduced under the edges of the sheet and then to withdraw therefrom at the beginning and at the end respectively of the bending operation of a long side of the sheet.

SUMMARY OF THE INVENTION

The object of the present invention is to provide a bending machine for the production of rectangular sheet metal panels in which the length of the blank holder can be programmed and varied during operation in a very simple, sure and accurate manner.

In accordance with the invention said object is achieved by a bending machine for the production of rectangular sheet metal panels comprising a vertically traversing blank holder, a fixed counterblade, two opposed blades fixed to the arms of a C support traversing vertically and means for positioning against the counterblade the metal sheet to be folded characterized in that said blank-holder consists of a plurality of blank holding elements placed side-by-side, and of replaceable end elements, all supported in a laterally running manner by a vertically movable support, and there is provided at least one running carriage programmer moving along the blank holder and which can be operated to modify the length of said blank holder by varying the position and/or replacing said end elements in combination with the creation of free spaces at the sides of said end elements.

It is also provided that the blank-holding elements and the end elements be constrained to the vertically moving support by means of a pair of cursors running in the longitudinal direction of the blank holder. This allows, alternately, expansion and contraction of the operative part of the blank holder in relation to its vertically movable support, after upward shifting of a central blank holder part the length of which is equal to the sum of the travels of the two cursors.

The two cursors run in guides made in the body of the blank holder and their lower base is preferably dovetailed to retain the plurality of the blank holder elements arranged one adjacent to the other. These elements have teeth which couple with the dovetail projection of the cursors and can run, using as guides, the dovetail projections of the cursors, one of which can be inflected to lock and unlock the blank, holder elements. During operation of the blank holder, the sliding of the elements is prevented by the pressure exercised by the flexible projection of the cursor on the teeth of the elements, by means of an appropriate pushing means.

The end elements have the lower base fitted with a flattened foot protruding laterally to penetrate under the beaded edges of the sheet metal.

Other end elements are placed in two magazine zones, each alignable with the cursors of the blank holder, so that the withdrawal means can act at the same height both on the cursors and on the magazine zones.

The magazine zones are made with vertically moving sections having the same cross-section as the blank holder cursors.

In the magazine zone there are available end elements with dimensions varying in a broad range of sizes, to adapt to the varying dimensions of the metal sheet to be bent.

The end elements are n on the left and n on the right of the blank holder. The series of their widths goes from a minimum p to a maximum $p+(n-1)d$ including all the values $p+(i-1)d$ with i going from 1 to n. The width of all the blank holder elements is nd.

With the widths of the elements thus predetermined, there can be composed blank holders of not more than 2d different lengths.

By replacing the two minimal end elements of width p (one left and one right to preserve the necessary symmetry) with the two end elements which follow them immediately in the series of widths, the total length of the blank holder is increased by 2d. After replacing the penultimate pair of end elements with the last, the length of the blank holder will be increased by $2(n-1)d$. At this point, replacing the last pair with the first of width p, but simultaneously adding two blank holder elements of width nd (one left and one right) to those already included between the two end elements the total length of the blank holder again increases by $2nd-2(n-1)d=2d$.

Other elements supported by the cursors consist of spacing elements placed near the end elements, but capable of being withdrawn therefrom to create empty spaces at the beaded edges of the metal sheet.

The programming means are carriages equipped with extensible and retractable coupling elements to withdraw and move the end elements placed on the respective cursors of the blank holder and in the magazine zones and the spacers.

Laterally in relation to the coupling elements of the carriages, there are provided separation elements in the form of horizontally extractable and retractable arms designed to penetrate between one blankholding element and the other and to space them to allow introduction of end elements in a modified position.

As mentioned above, each programming carriage traverses along the blank holder in a guide and is moved by a screw coupled with an internally threaded cursor integral with the carriage, the screw being rotated in one direction or the other by a suitable motor.

At the ends of the blank holder there is located, on a guide integral therewith, a square carriage called a 'packer', the function of which is to eliminate the spaces formed between one element and the other of the blank holder after movements and replacements of the end elements.

Each programming carriage is programmed in such a manner as to recognize the elements contained in the magazine zone and the position in which replacement of the end element must be performed, immediately after which the carriage will insert the spacer.

The spacers comprise a hydraulic cylinder allowing them to move toward the end of their cursor, drawing away from the end element by a distance equal to the height of the major bend produced in the panel being processed. These movements of the spacers are necessary to form openings in which to place the two edges of the panel previously bent, preventing interference between said edges and said spacers.

To perform the withdrawal, replacement and moving of the end elements and the spacer, both on the cursors and the magazine zones, the elements are also provided with teeth which, during the active phase of the blank holder, are constrained to the cursor and, during the element replacement phases, are decoupled from the dovetail projection of the cursors to make possible detachment from said elements. Detachment of the elements takes place after release of the pressure exerted by the flexible projection of the cursor.

The elements taken are also provided with passages to receive elements for coupling the programming carriages. The mutual engagement between the part and the element is secured by means of pins protruding from the internal sides of the connecting parts, which penetrate oblique grooves made in moving sections of a vertical wall of the passages of the parts taken.

Traversing of the moving sections causes withdrawal of the tooth of the withdrawable element from the dovetail projection and the resulting detachment of the cursor element.

Contraction of the blank holder, which is required in the emergence phase of the blank holder from a panel with the edges bent inward, is secured by traversing of the cursors along their respective guides.

To produce boxed panels , i.e. having the edges bent inward, the blank holder will be arranged with a total length equal to the length of the major side of the panel, the thickness of the sheet metal being detracted twice.

After bending the second minor side, the blank holder rises to allow withdrawal and rotation of the panel. When rotation has been completed and the panel is sufficiently far from the blank holder and with one long side parallel to the blank holder, the blank holder lowers to a short distance from the fixed counterblade without interfering with the bends already made on the short sides.

The panel is advanced so as to appropriately position on the counterblade the long side to be bent and, in this movement, the bends on the short sides place themselves in the recesses overlying the flattened feet of the end elements of the blank holder.

Then, one of the two blades makes a first bend. The panel is advanced, positioning the next edge to be bent and the proper blade is operated again. Then, after lifting of the central element the cursors are traversed toward the center of the machine, causing shortening of the blank holder. The blank holder is lifted.

The traversing movements of the cursors are programmed each time for each type of panel and are driven by suitable motors placed at the ends of the cursors.

BRIEF DESCRIPTION OF THE DRAWINGS

One possible form of practical accomplishment of the present invention is illustrated as a nonlimiting example in the annexed drawings, wherein.

DETAILED DESCRIPTION

Figure 1:
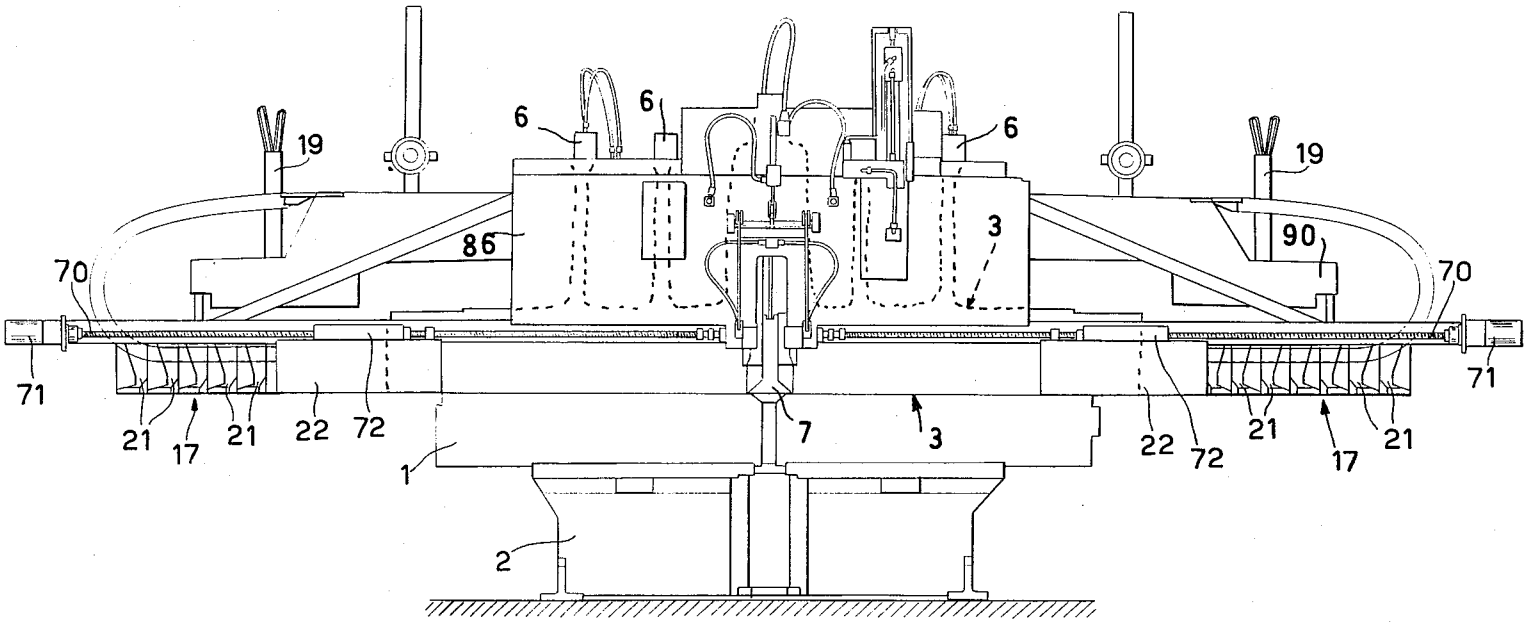
FIG. 1 shows a schematic front view of a bending machine for the production of rectangular sheet metal panels in accordance with the present invention.

In FIG. 1 is shown the front view of the bending machine which comprises a fixed frame 1 having a bed 2 resting on the floor.

Within the fixed frame 1 slides vertically a blank holder 3 (FIG. 2) the body 4 of which is moved by hydraulic pistons (not shown) with the aid of guides 6. The blank holder 3 is partially hidden by a front panel 86 in FIG. 1.

The blank holder 3 comprises a vertically movable central block 7 (FIG. 2) at the sides of which are supported by the body 4 two cursors 8 with ribs 69 sliding in guides 9 (FIGS. 3 and 7) made on the lower side of said body 4. On each cursor 8 (FIG. 2) are releasably hooked a series of blank-holding elements 10, an end element 11 and a spacer 12.

Figure 3:
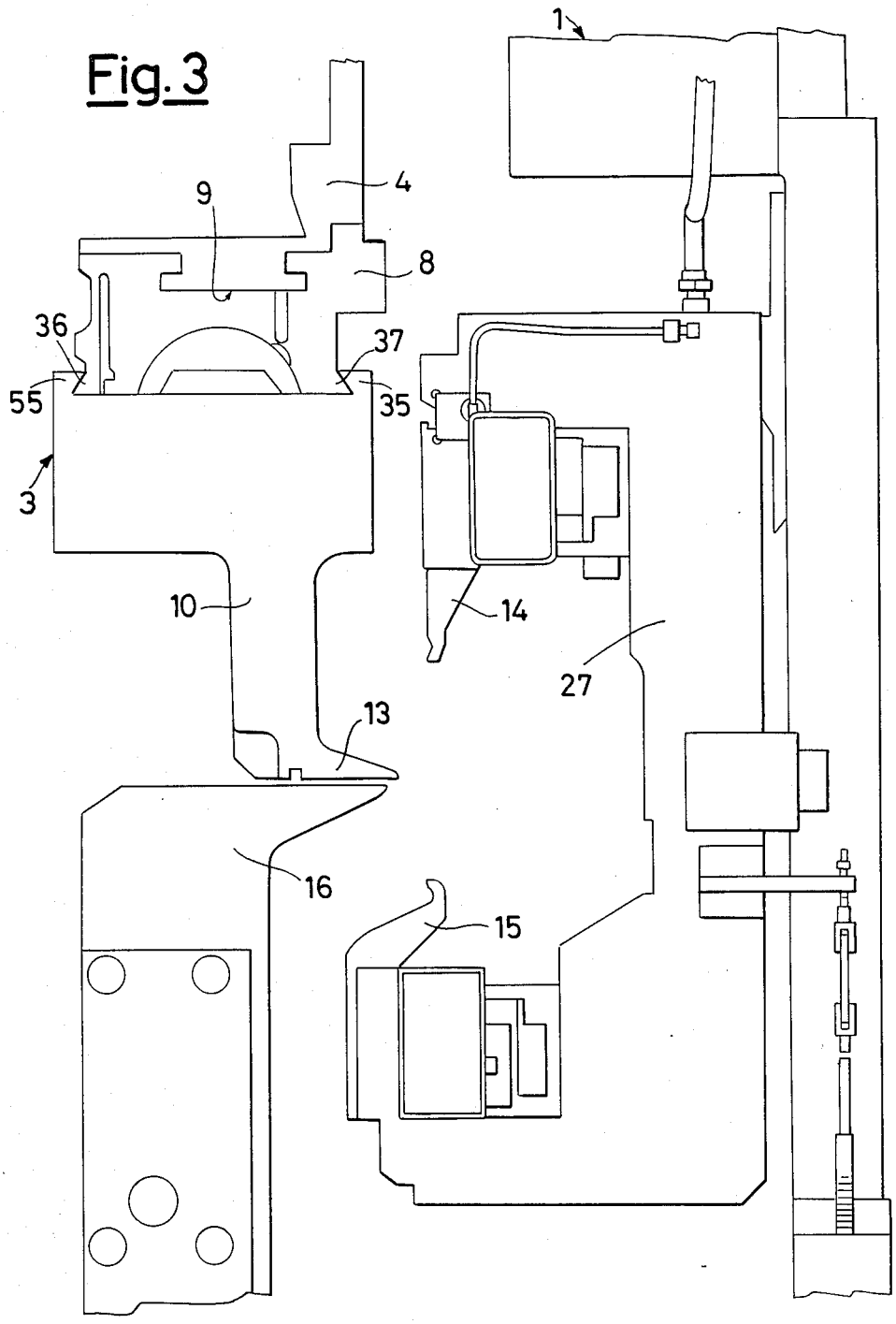
FIG. 3 shows a partial cutaway side view of the machine.
Figure 7:
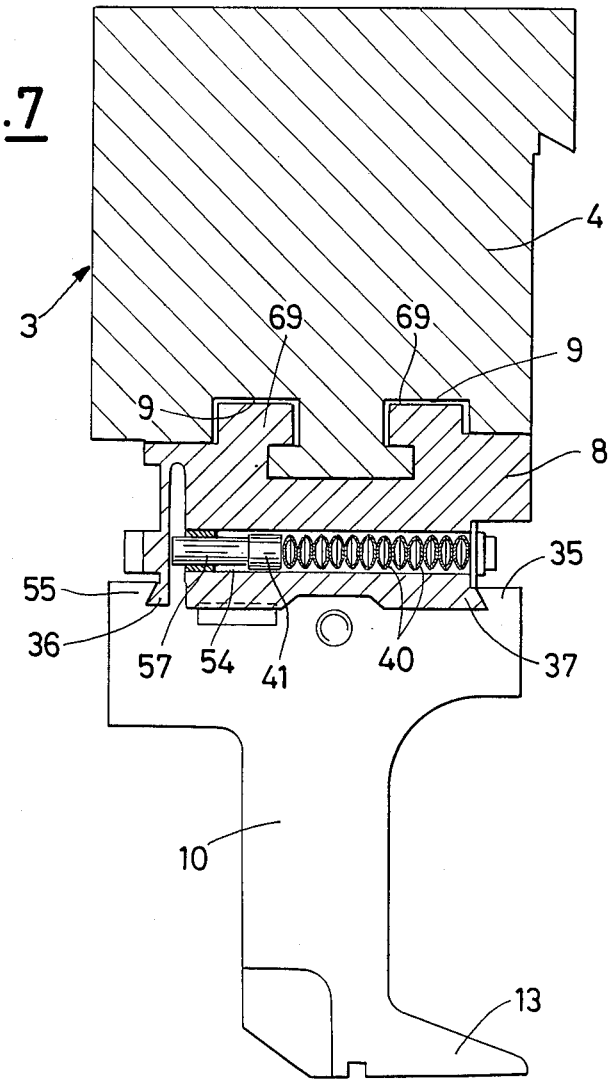
FIG. 7 shows a cutaway view of a detail of the blank holder of the machine.
Figure 8:
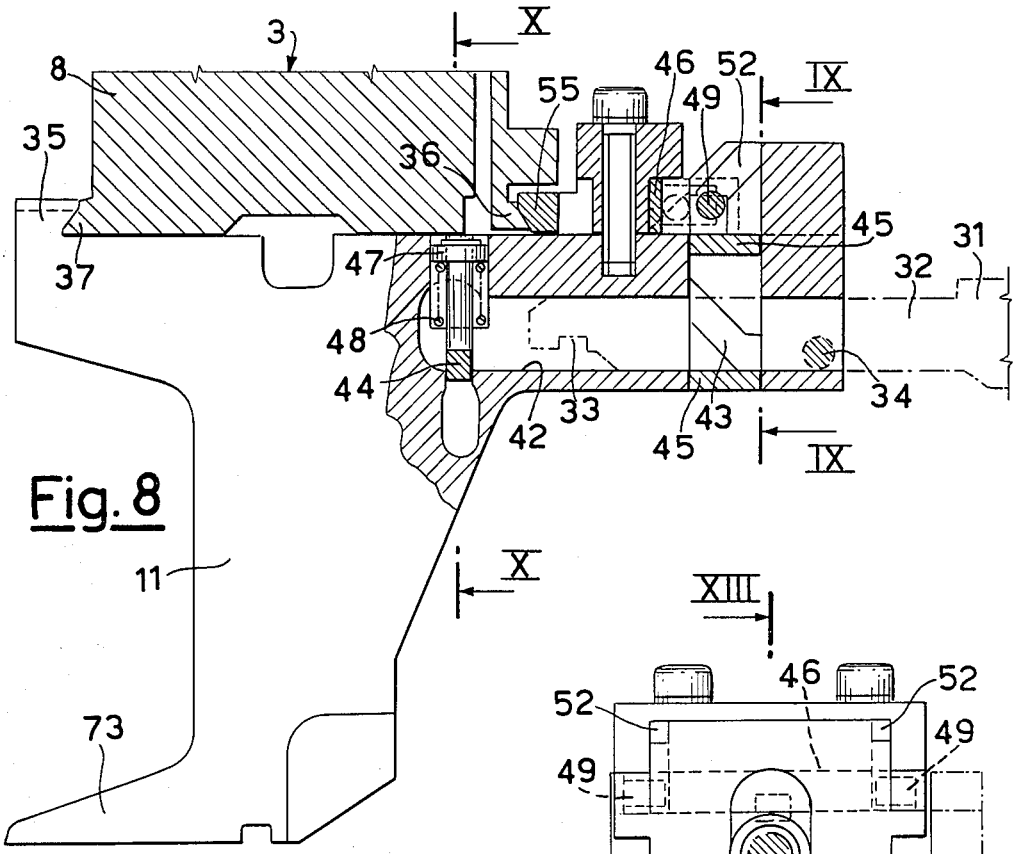
FIG. 8 shows a partially cutaway side view of an end element in the preliminary phase of withdrawal of the programming carriage.
Figure 9:
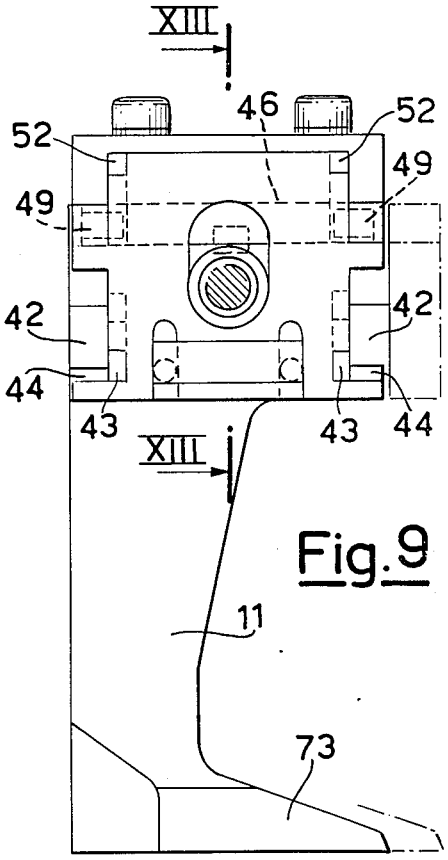
FIG. 9 shows a cutaway view along line IX—IX of FIG. 8.

As can be seen in FIGS. 3 and 7, the cursor 8 has the lower part of its cross-section in dovetail form. The elements 10 and 11 (FIGS. 3 and 7–9) of the blank holders each have the form of a boot in which fit the respective feet 13 and 73 to act on the sheet to be folded and which is supported on the counterblade 16. The feet 73, as can be seen in FIGS. 8 and 9, protrude toward the inside of the machine and sidewise from the element 11, while the feet 13 protrude toward the inside of the machine from the element 10, as may be seen in FIGS. 3 and 7.

FIG. 3 shows a side view of the machine in which is seen a pair of conventional bending blades 14 and 15 which are opposing and fixed to a support 27 in the form of the letter C. The support 27 slides vertically and the blades 14 and 15, having also a swinging movement around a horizontal axis by means of known mechanisms, cooperate with a stationary counterblade 16 supported by the base 2 and with the blank holder 3 to bend downwards and upwards, respectively, the lateral edge of a metal sheet held between the counterblade 16 and the blank holder 3.

Figure 4:
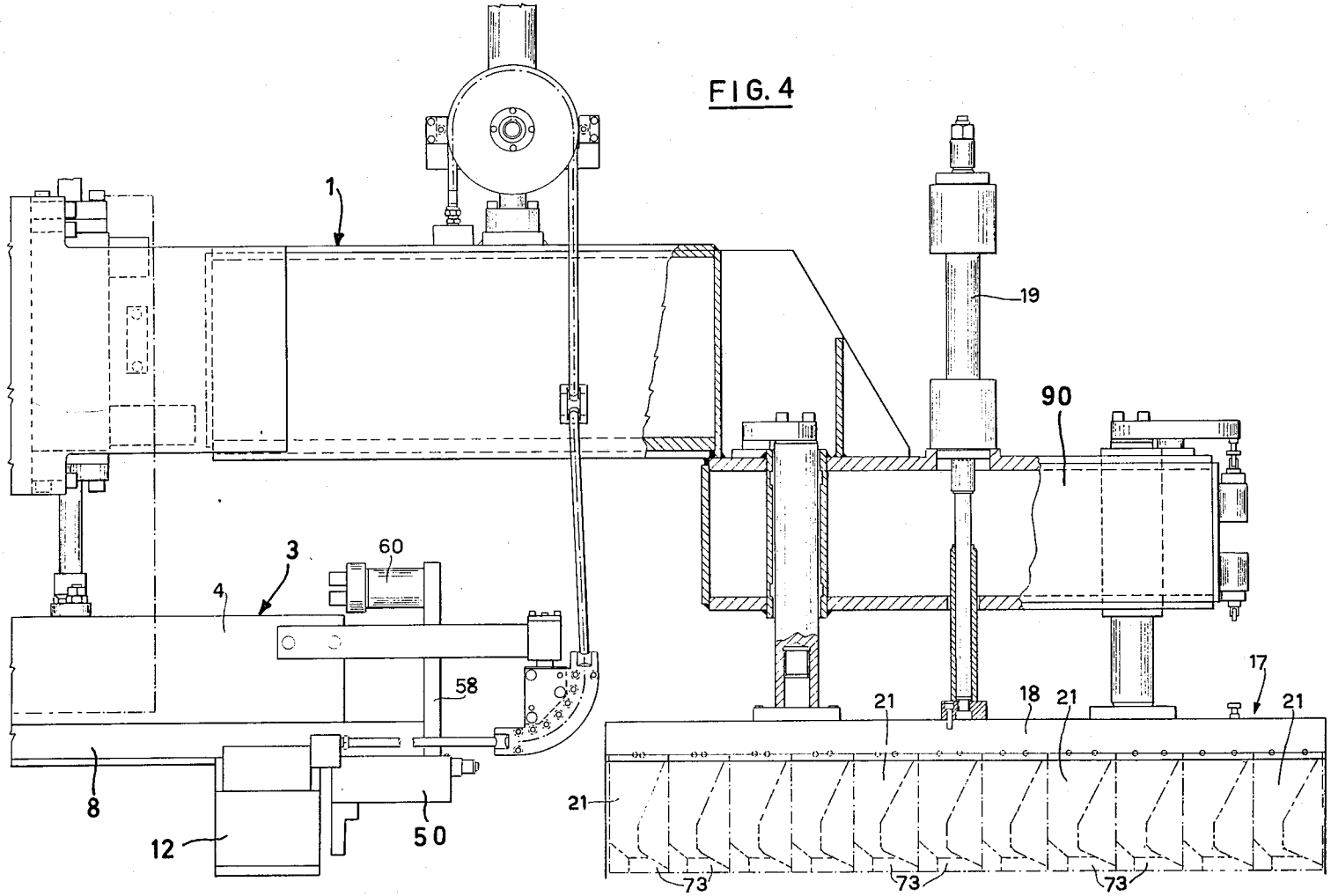
FIG. 4 shows a partially cutaway front view of a magazine zone included in the machine.
Figure 5:
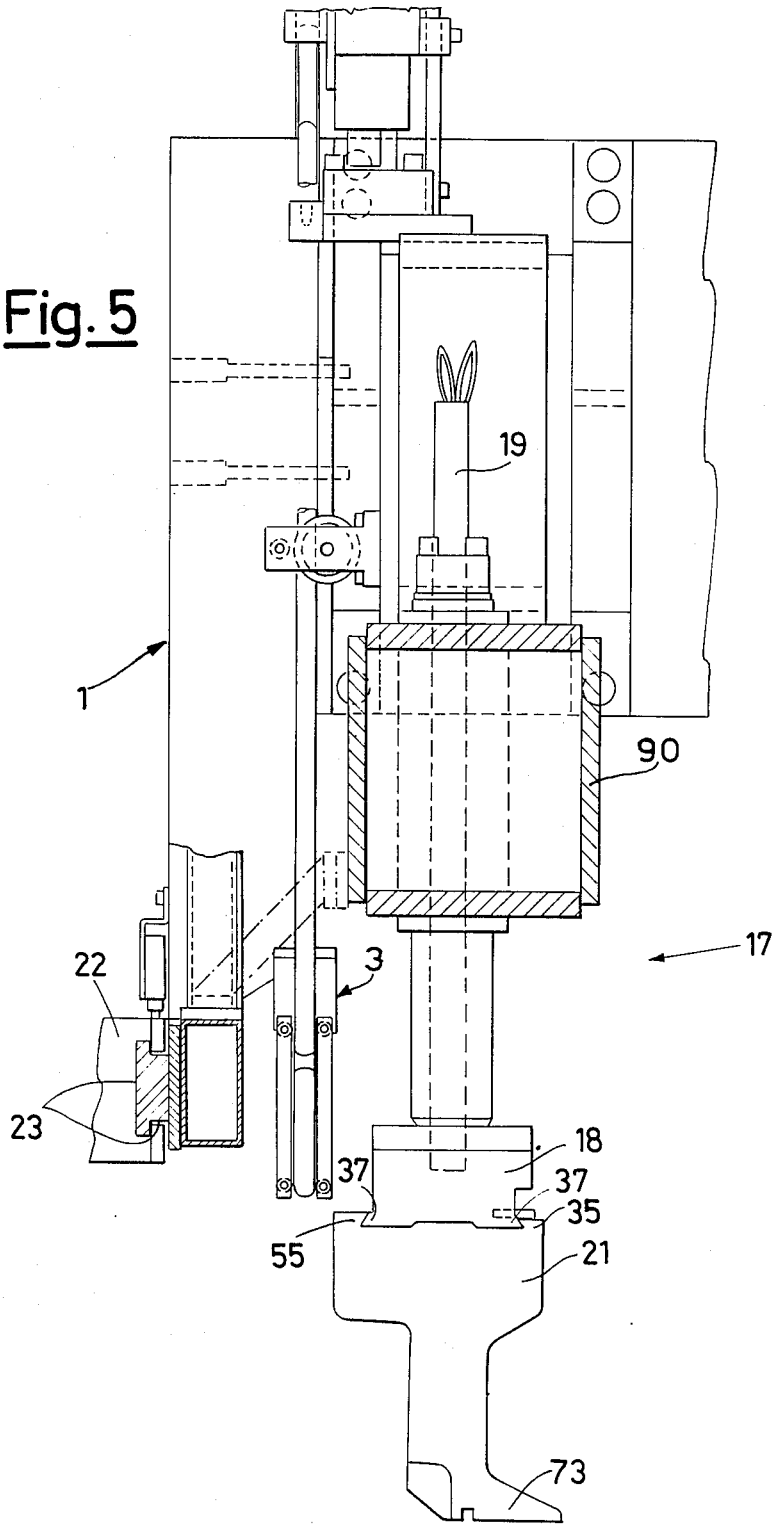
FIG. 5 shows a cross-section of the magazine zone.

At the sides of the blank holder 3 are provided magazine zones (FIGS. 4 and 5), each of which consists of a stock 18 having the same cross, section as the cursor 8 of the blank holder 3, the top side of the stock 18 being integral with the piston rod of a hydraulic cylinder 19 carried by a support 90 fastened to the frame 1. On the lower side are arranged a series of end elements 21 having the same shape as the elements 11, but different width of the foot 23 to adapt themselves to the various width of the metal sheets to be bent.

To take the end elements 11 from the blank holder 3 and replace them with those 21 contained in the magazine 17, as well as for the mere movement of the elements 11 from one space to another between the various blank-holding elements 10, there are provided two programming carriages 22, which run horizontally and parallel to the two cursors 8 on guides 23 (FIG. 5), integral with the frame 1.

Each carriage 22 is driven by a motor 71 connected to a screw 70 which couples with a female screw 72 integral with the carriage (FIG. 1).

It is, thus, rotation of the screw 70 in one direction or the other which causes the carriage 22 to slide. The free ends of the screw 70 are supported by the frame 1 in the center and at the side end of the machine (FIG. 1).

The programming carriages 22 (FIG. 6) are equipped with extensible and retractable hooks 24, 25, 26 for hooking and unhooking the end elements 11 and the spacers 12 to or from the cursors 8, as well as the end elements 21 to or from the magazine zone 17. In this manner, the end elements 11 can be substituted by other end elements 21 housed in the magazine zone 17, or the elements 11 can be merely moved from one position to another along the cursors 8, depending on the size of the metal sheet to be bent.

At the sides of the hook members 24, 25 and 26, of the carriages 22, are placed extensible and retractable horizontal arms 28 and 29 called splitters, designed to penetrate between one element and another of the blank holder and to space them to gain new space for the element or elements to be inserted.

Extention and retraction of the arms 28 and 29 and lengthening and shortening of the hook members 24, 25 and 26 are accomplished by means of hydraulic pistons 30.

To assemble the spaced elements at the end of the substitution operations, by causing them to run along the cursor 8, there are provided square carriages 50 called 'packers', which run on dovetail guides 36, 37 of the cursor 8 under the control of a screw 51 which cooperates with a female screw 53, integral with the carriage 50, and is driven by a motor 60 installed on the cursor, to which it is connected by a chain transmission 56 (FIG. 52).

Each one of the elements 10, 11, 12 and 21 is hooked either to the cursor 8 or to the stock 18 of the magazine 17 by means of teeth 35 and 55, which couple with the dovetail projections 36 and 37 of the cursors 8 and the stocks 18 so that the elements use the projections 36 and 37 as running guides (FIG. 7).

Specifically, the tooth 35 couples with the fixed projection 37 and the tooth 55 couples with the flexible projection 36.

Figure 2:
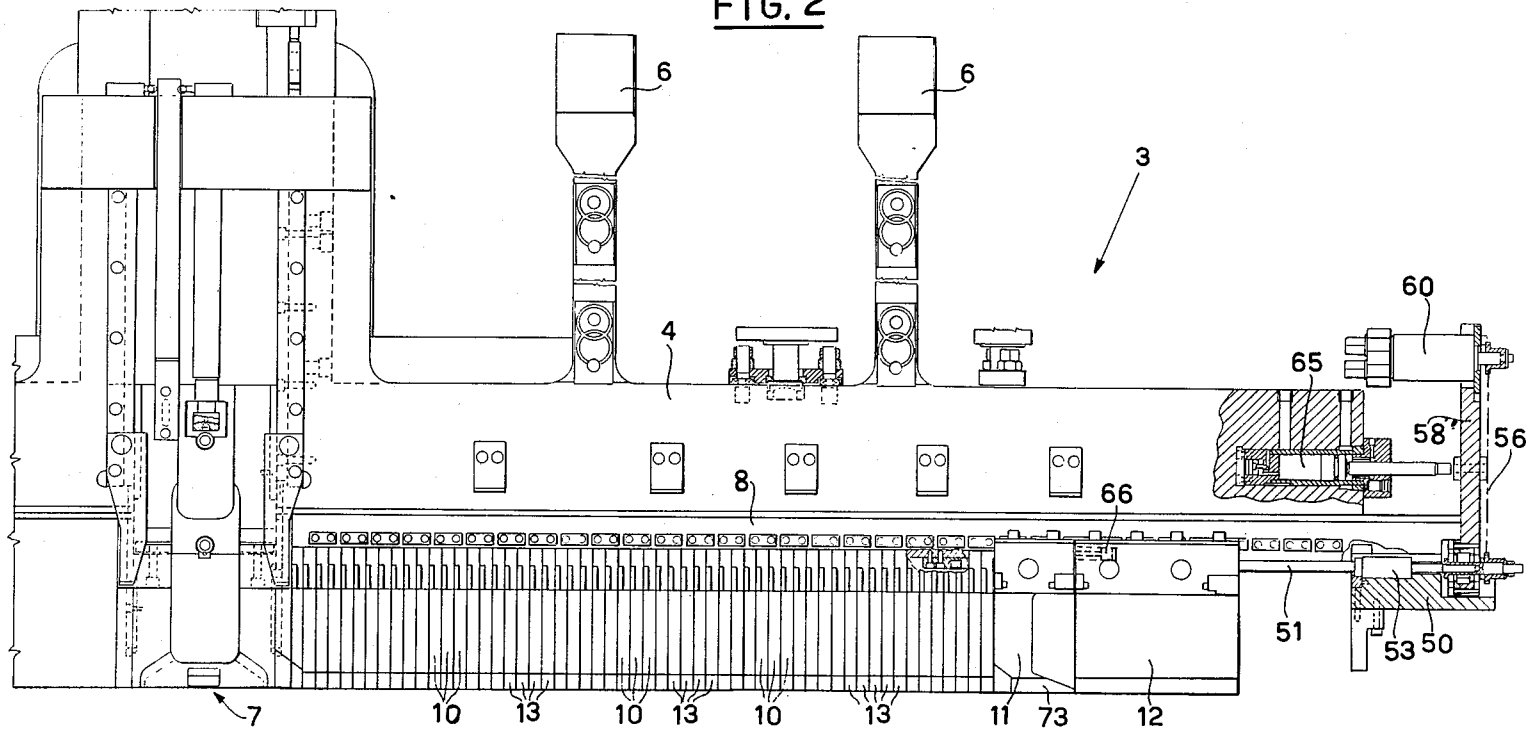
FIG. 2 shows a front view of one half of the blank holder included in the machine illustrated in FIG. 1.

To lock the elements 10–12 and 21 in fixed position, the flexible projection 36 is pressed against the teeth 55 by several pushing means distributed along the cursors, each one consisting of a rod 57 integral with a piston head 41 which runs in a horizontal recess 54 under the thrust of Belleville washers. The thrust of the Belleville washers can be cancelled-out by supplying oil to the recess 54 to act hydraulically on the action of the pistons 41. Before locking of the elements 10, 11 and 12 in fixed position in the blank holder 3, it is necessary that each spacer 12 be withdrawn from the adjacent end element 11 to create a space in which is placed the edge of one of the two sides of the panel bent first. Withdrawal of the spacer is caused by the thrust exerted by a hydraulic piston 66 included in the spacer and which acts upon the adjacent end element 11 (FIG. 2).

Each cursor 8 is, in turn, movable along the body 4 of the blank holder 3, in order to secure contraction and expansion of the blank holder. The movement is controlled by a hydraulic piston 65 (FIG. 2), which acts on a plate 58 fixed to the cursor 8.

FIG. 8 shows the operation of the programming carriage 22 for taking an end element 11 from the blank holder.

Figure 6:
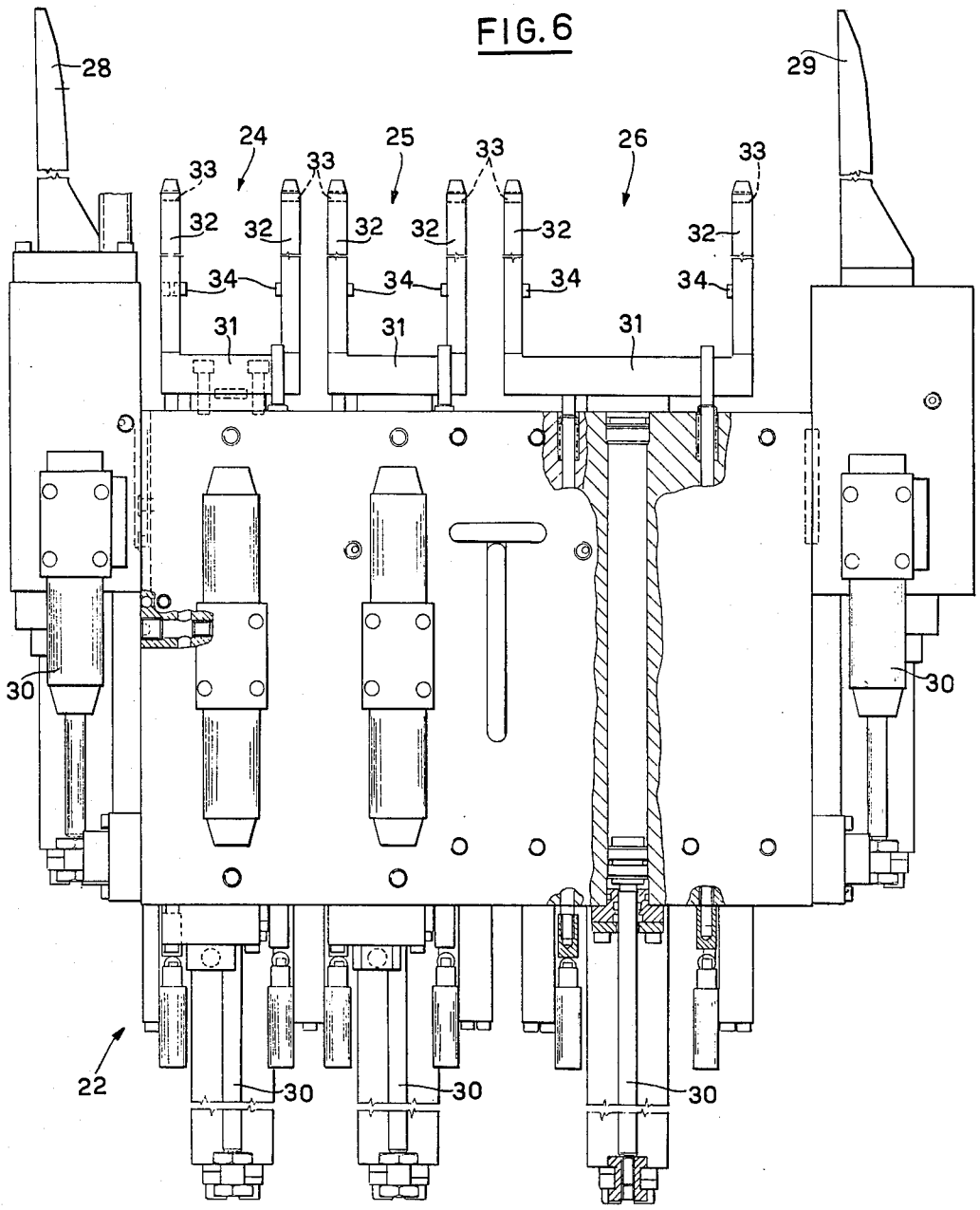
FIG. 6 shows a partially cutaway top view of a programming carriage of the machine.

Each hooking member of a carriage 22 comprises a fork 31 the arms 32 of which have, at the end of the lower side, a recess 33 and, along the inner sides, protruding pins 34 (FIGS. 6 and 8).

Figure 11:
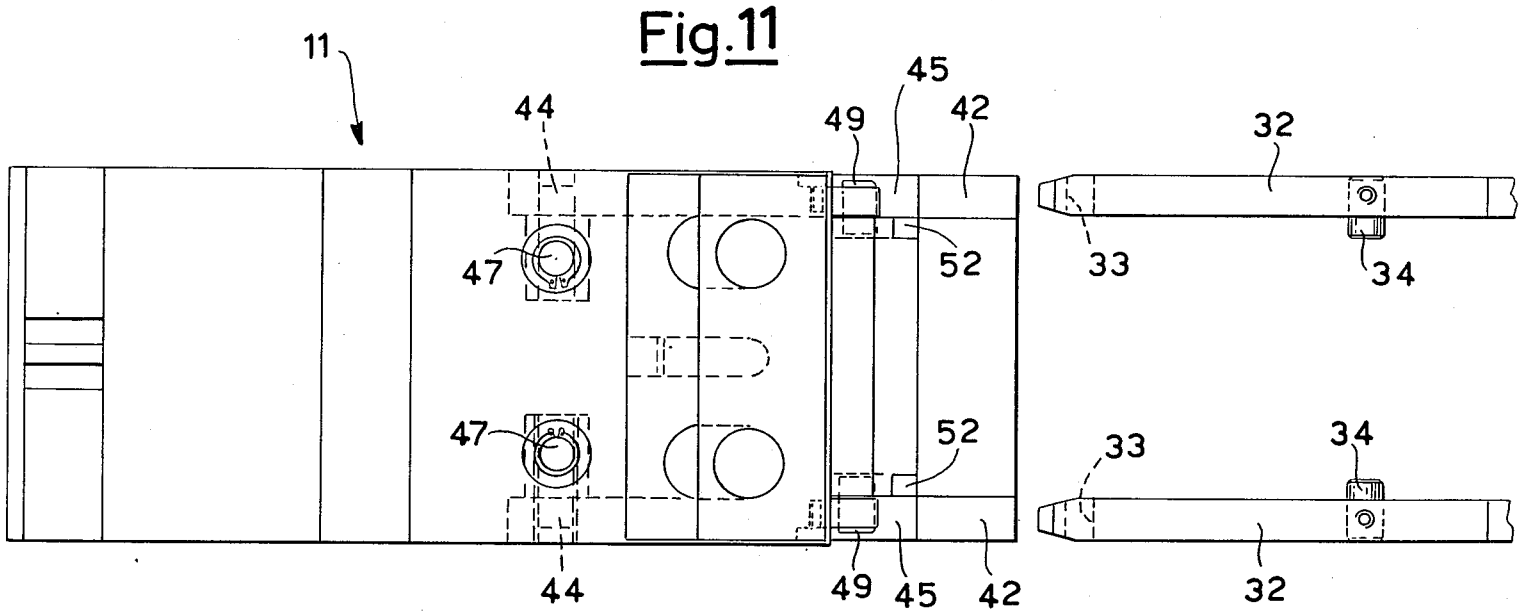
FIG. 11 shows a top view of an end element.

The arms 32 of the fork 31 are introduced in horizontal passages 42 made in the upper part of the element (FIGS. 9 and 11). Simultaneously, their protruding pins 34 advance toward a first pair of oblique grooves 43 inclined in the direction of approach to the cursor 8 and made in a moving section 45 of the element 11 along the wall facing the passage 42.

Figure 12:
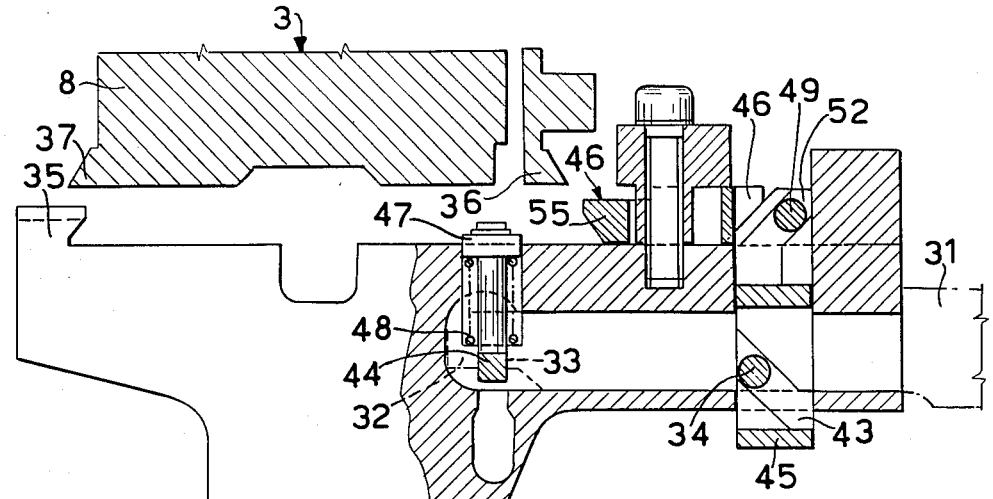
FIG. 12 shows a partially cutaway side view of an end element hooked to the withdrawal carriage.

The moving section 45, pushed downward by the pins 34 while they run through the pair of grooves 43, causes withdrawal of a running insert 46, with resulting retraction of the tooth 55 integral therewith the tooth unhooking from the flexible projection 36 (FIG. 12).

The insert 46 withdraws, being connected to the moving section 45 by two hubs 49, integral with said insert 46 and opposing one another, which hubs are obliged to run in a second pair of oblique grooves 52, inclined in the direction opposed to that of the first grooves 43, and made in the moving section 45 above the first oblique grooves 43. In other words, while the protruding pins 34 run in the first pair of grooves 43 advancing toward the cursor 8, the hubs 49 run through the second pair of oblique grooves 52 withdrawing from the cursor due to the effect of the descent of the moving section 45 and entrain the insert 46 which, being integral with the hubs 49, will also withdraw from the cursor 8.

Figure 13:
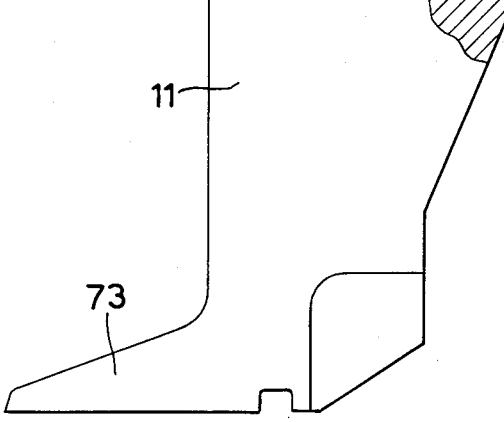
FIG. 13 shows a cutaway view along line XIII—XIII of FIG. 9.
Figure 14:
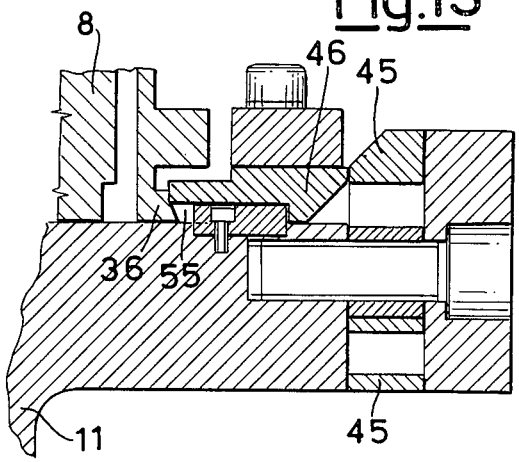
FIG. 14 shows the cutaway view illustrated in FIG. 13 but after unhooking of an end element from the blank holder cursor.
Figure 14:
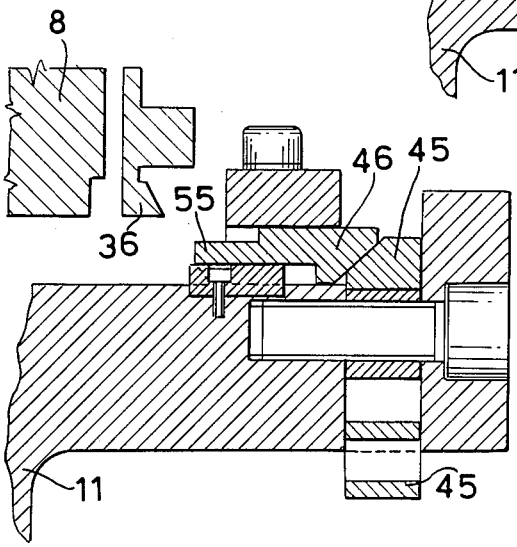

In FIGS. 13 and 14 are illustrated, respectively, the conditions of coupling and disengagement of the tooth 55 of the insert 46 with the flexible projection 36 which correspond to the conditions of hooking and release of the element from the cursor.

Figure 10:
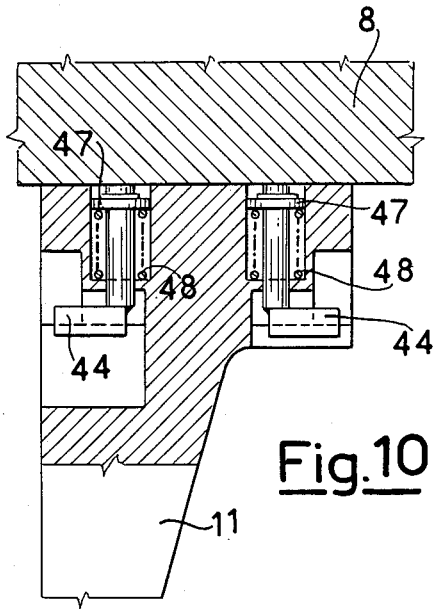
FIG. 10 shows a cutaway view along line X—X of FIG. 8.

After disengagement of said tooth 55 from the projection 36, the blank holder 3 can rise with the cursor 8 (FIG. 12), permitting hooking in the recess 33 of the arms 32 of the fork 31 introduced in the element 11, 12 or 21 of moving tabs 44 (FIG. 10) included in the element 11 or 12 or 21. This is allowed by the lifting of the tabs 44 by springs 48 compressed by a piston 47 which extend as soon as the elements 11, 12 or 21 are detached from the cursor 8 or from the stock 18 (FIG. 12).

The reverse process is performed by the hooking of an element substituted or moved on the stocks 18 of the magazine zones 17 or on the cursors 8.

The bending machine described is designed to operate as follows.

Let it be assumed that the machine is to be set for bending a metal sheet having dimensions different from those for which is was prepared.

The length of the blank holder is then modified by performing the following operations.

The blank holder 3 is lifted and hooked in a fixed position. Then, the pistons 41 are actuated and, overcoming the pressure exerted by the Belleville washers 40 (FIG. 7), allow release of the flexible projection 36, permitting running of the hooked elements 10, 11 and 12. At the same time, the magazine zones 17 are lowered to the same height as the cursors 8 by the hydraulic piston 19.

The programming carriages reach the magazine zones 17 while the thrusting piston, acting on the spacers 12 (FIG. 2) are inactivated.

The carriages 22, by means of hooks 25, take from respective stocks 18 the elements 21 which the data processing unit has determined to be best suited for the dimensions of the metal sheet to be bent.

The hooks 25 retract, carrying with them the two elements 21. Then, the magazine zones 17 rise again.

The carriages 22 move toward the central block 7 of the blank holder and reach a position such that the inner face of the arms 28, which are those nearest the center of the blank holder 3, takes a position corresponding to that of the face of the spacer 13 which is turned toward the central block 7 of the blank holder, then penetrate into appropriate openings provided in the spacers 12 and by sliding the carriages 22 toward the outside of the blank holder the spacers 12 are spaced from the adjacent end elements 11 by a distance such that one or more end elements 21 hanging from the members 25 can be inserted. Then, the members 24 take from the cursors 8 the elements 11, which are then replaced by the elements 21. After replacement, the square carraiges 50 push the elements 10–12 towards the central block 7 to close the spaces created, and then the hydraulic pistons 66 withdraw the spacers 12 from the end elements 11 by a distance equal to the height of the major bend to be produced in the panel. The elements 10–12 contained by the cursors 8 are then blocked by acting on the flexible projection 36 by means of the pistons 57 stressed by the Belleville washers 40 and the blank holder is ready for bending.

The carriages now carry the end elements 11 taken by the cursors 8 toward the magazine zones 17 and the hooks 24 place the elements on the stocks 18. Then, the magazine zones 17 rise again.

If the end elements 21 taken by the trunks 18 (or the same elements 11 already in use) are to be placed in locations different from those in which are found the end elements 11, the carriages perform the following operations.

Optionally, after taking the elements 21 from the stocks 18 of the respective magazine zones 17, the carriages 22 move toward the center of the blank holder and stop with the hooks 24 and 26 in positions such as to take, respectively, the end elements 11 and the spacers 12, after which they traverse along the blank holder until one or the other of the arms 28 or 29 is brought with its inner face adjacent to the inner face of one of the central elements 10 selected by the data processing unit. The arm 28 or 29 then penetrates between the elements 10 and, with a traversing of the carriages outward, there are created two spaces (one each) such as to allow introduction of the end elements 11 or 21 and the spacer elements 12 hooked on the respective carriages 22. After placement of the elements 21 and 12, there act again, the square carriages 50 which eliminate the spaces possibly existing between the elements of the blank holder. Then, each spacer 12 moves outward again by the established distance, while the carriages 22 discharge the end elements 11 substituted on the stocks 18.

The elements 10, 11 and 12 are again blocked as described above.

The bending machine is now ready to carry out bending of the edges of a metal sheet by means of the blades 14 and 15 in a fully conventional manner.

When it is necessary to produce sheet metal panels with edges bent inward, the blank holder, during bending of the long sides, which normally takes place after bending of the short sides, holds inserted the feet 73 protruding laterally from its end elements 11 under the edges previously bent, without interfering with them.

After bending, by raising the central block 7 and by operating on the pistons 65 to cause sliding of the cursors 8 towards the center of the machine, the blank holder contracts and can be lifted to withdraw from the panel produced without interfering with the bent edges.

I claim:

1. A bending machine for manufacturing sheet metal panels, comprising:

a fixed counterblade;

a blank holder vertically movable to and from said counterblade;

a pair of bending blades carried by a C-like support vertically movable with respect to said counterblade;

said blank holder comprising a vertically movable support and a succession of adjacent blank-holding elements slidingly carried by said vertically movable support;

said blank-holding elements comprising thinner central elements, removable thicker end elements and removable spacers arranged at respective ends of said succession of blank-holding elements and provided with means for forming free spaces near said end elements;

width-adjusting means for the blank holder, including at least one magazine for removable end elements which have a same shape but different width with respect to said end elements of the blank holder;

at least one running carriage programmer movable along the blank holder and between said magazine and said blank holder and provided with means for taking said end elements and said spacers from said blank holder and said magazine and selectively moving said end elements and said spacers from the magazine to the blank holder and vice versa or to different positions in the blank holder and with means for selectively defining between said blank holding elements free spaces for taking and introducing said end elements and said spacers; and means for grouping said blank-holding elements at the conclusion of each taking and introducing operation.

2. A bending machine in accordance with claim 1 characterized in that said elements of the blank holder are constrained to said support by means of a pair of cursors running in the longitudinal direction of the blank holder after rising of a central spacing block.

3. A bending machine in accordance with claim 2 characterized in that the cursors have a lower base in dovetail form of which the projections are used as guides by the elements making up the blank holder.

4. A bending machine in accordance with claim 3 characterized in that one of the dovetail projections is flexible.

5. A bending machine in accordance with claim 1 characterized in that the magazine zones comprise stocks on which are retained the end elements, said stocks having the same cross section as the cursors of the blank holder.

6. A bending machine in accordance with claim 1 characterized in that said running programming carriage comprises extensible and retractable hooks to take and replace the end elements on the respective cursors of the blank holder, the end elements on the stocks of the magazine zone and the spacers.

7. A bending machine in accordance with claim 6 characterized in that said programmer also comprises extensible and retractable arms placed at the sides of the hooks.

8. A bending machine in accordance with claim 7 characterized in that the hooks and the arms are actuated by hydraulic pistons.

9. A bending machine in accordance with claim 6 characterized in that said hooks consist of forks of which the arms are equipped along the opposing sides with protruding pins and have shaped ends with recesses in their lower part.

10. A bending machine in accordance with claim 1 characterized in that it is equipped with square carriages which run on said cursors of the blank holder to press said elements against each other.

11. A bending machine in accordance with claim 10 characterized in that running of the square carriages is secured by motors supported on the cursors.

12. A bending machine in accordance with claim 2 characterized in that there is provided a hydraulic piston in the body of the blank holder to effect the running of the cursors on the guides of the body of the blank holder.

13. A bending machine in accordance with claim 1 characterized in that each programmer is driven by a motor through a screw coupled to an internally threaded cursor integral with the programmer, the free end of the screw being supported by the frame of the machine.

14. A bending machine in accordance with claim 3 characterized in that the blank holder elements and the end elements and the spacers retained on the cursors and the end elements retained on the stocks of the magazine zones have teeth which couple with the dovetail projections of the cursors, the teeth being fixed and coupled to the fixed projections and the teeth retractable and coupled with the flexible projections.

15. A bending machine in accordance with claim 14 characterized in that the flexible projection is pressed elastically against said retractable teeth there being provided hydraulic means which can be operated to overcome said elastic action and release said flexible projection.

16. A bending machine in accordance with claim 6, characterized in that the end elements of the blankholder and the stocks and the spacers of the blankholder have in their lower part horizontal passages in which penetrate the arms of the hooks.

17. A bending machine in accordance with claim 9 characterized in that the protruding pins of the arms of the hooks penetrate a first pair of oblique grooves made in a moving section of the end element along the walls facing the passages causing said moving section to traverse vertically said oblique grooves being inclined in the direction of approach to the cursor.

18. A bending machine in accordance with claim 17 characterized in that the moving section is connected to an insert integral with the retractable tooth and running horizontally by means of hubs integral with said insert and mutually opposed which are obliged to run in a second pair of grooves inclined in the direction opposite to the oblique grooves of the first pair and made in the moving section above said first oblique grooves.

19. A bending machine in accordance with claim 16 characterized in that the end elements and the spacers house in recesses made in their upper part pins moving vertically which under the thrust of springs penetrate in the recess provided below on the ends of the arms of the hooks, said springs being opposed by a piston.

20. A bending machine in accordance with claim 1 characterized in that the spacers are associated with a hydraulic piston which operates each time said spacers must withdraw from the end elements adjacent thereto.

* * * * *